United States Patent [19]

Sievers

[11] Patent Number: 4,950,963

[45] Date of Patent: Aug. 21, 1990

[54] AUTOMATIC LIGHT DIMMER FOR GAS DISCHARGE LAMPS

[76] Inventor: Richard L. Sievers, 1221 Gardenia, New Braunfels, Tex. 78130

[21] Appl. No.: 190,638

[22] Filed: May 5, 1988

[51] Int. Cl.[5] ..... H05B 37/02

[52] U.S. Cl. ..... 315/360; 315/DIG. 4

[58] Field of Search ..... 315/158, 225, 307, 360, 315/DIG. 4

[56] References Cited

U.S. PATENT DOCUMENTS 4,287,455 9/1981 Drieu ..... 315/DIG. 4 X 4,791,338 12/1988 Dean et al. ..... 315/DIG. 4 X

*Primary Examiner*—Robert J. Pascal

*Attorney, Agent, or Firm*—Cox & Smith Incorporated

[57] ABSTRACT

A power saving dimming apparatus for gas discharge lamps is disclosed. The apparatus provides a means for applying full power to the lamp for a preselected time whenever the lamp is turned on. After the preselected time has passed, the lamp is maintained in an adjustable dimmed state.

7 Claims, 2 Drawing Sheets

AUTOMATIC LIGHT DIMMER FOR GAS DISCHARGE LAMPS

BACKGROUND OF THE INVENTION

The present invention relates to an apparatus for automatically dimming gas discharge lamps. The apparatus allows gas discharge lamps to be started and then automatically dimmed with no further operator intervention.

A gas discharge lamp basically comprises a tube containing a suitable gas mixture across which is impressed an AC voltage. Gases do not normally conduct electricity since they normally contain neither free electrons nor positive ions. However, if the gas is ionized to some degree, thereby separating electrons from their individual atoms, the resulting free electrons and positive ions may both contribute to the flow of current. The flow of positive ions contributes very little to the total current, however, due to the fact that the positive ions have much greater mass than the electrons and consequently move more slowly under the influence of the same electric field.

When a free electron collides with a neutral gas atom, one of three things may happen: an elastic collision may occur, the atom may be excited above its ground state, or the atom may be ionized releasing one of its electrons. Which of these events occurs depends on the energy of the electron involved in the collision, ionization requiring the highest energy. At each ionizing collision of an electron with a neutral atom, two free electrons are produced in place of one. Successive ionizing collisions, therefore, result in a cumulative buildup in the numbers of free electrons and ions provided that loss is due to recombination and the fusion to the walls of the tube are not excessive. It is the production of charged particles by this cumulative ionization which enables the gas to conduct electricity. The conductivity of the gas is proportional to the ion concentration. Since the ion concentration increases with the total current due to the cumulative ionization, the volt-ampere characteristic of the gas discharge tube has a negative slope. This means that the lamp is not inherently current limiting and for stable operation from a constant voltage supply, the circuit must include a current limiting device such as a resistor. For AC operation, the resistor may be replaced by a reactive impedance such as a transformer or autotransformer which minimizes power losses. Such a resistance or inductive impedance is often called a ballast.

Light is produced by the lamp when collisions between electrons and atoms are insufficient to produce ionization but rather excite electrons to higher energy levels. The energy level may be regarded as a possible orbit for one of the outer electrons of the atom, the highest energy level being equal to the ionization energy when the electron escapes from the atom. An electron and an atom which is raised from the ground state, i.e., the lowest energy level by collision with a free electron, remains in the higher level for a short period and then falls back to the ground state emitting a photon. The resulting light may then be pass through the tube directly or, as in fluorescent lamps, the photons emitted by the gas atoms may excite a phosphor coating on the inside of the tube which then emits light through the process of fluorescence.

Once sufficient cumulative ionization has occurred, a gas discharge lamp will conduct electricity and emit light as long as a sufficient voltage is maintained across the electrodes to accelerate the free electrons within the gas. A continuous supply of electrons is provided by each electrode alternately acting as a cathode during opposite phases of the AC cycle. Upon initial application of the normal operating voltage across the electrodes, however, insufficient numbers of free electrons exist in order to begin the cumulative ionization which carries the lamp current and maintains the discharge. Therefore, the electrodes must first be heated to thermionic emission temperature in order to produce the required free electrons. After conduction through the lamp has begun, it is not necessary for the thermionic emission to continue.

Various methods have been employed to start gas discharge lamps, and, in particular, fluorescent lamps. One method is to use a starter switch SS1 which conducts the initially applied electrical current across both electrodes E1 of the lamp L as shown in FIG. 1. Once the electrodes have been electrically heated to thermionic emission temperature, the switch is opened, and the lamp is started.

Since the switch in the above method must be replaced periodically, starterless circuits have also been devised. In this method, as shown in FIG. 2, AC current is applied to the lamp ballast B1. The ballast may be either a conventional transformer or, as is shown in FIG. 2, an autotransformer. In either case, a portion of the transformer's output is tapped for each electrode E1 in order to produce a current which heats the electrode to thermionic emission temperature.

For reason of both energy efficiency and consumer preference, it is desirable to incorporate dimming devices into fluorescent lamp circuits. Such dimming devices, which are well-known in the art, generally use solid state components such as silicon controlled rectifiers (SCR's) to block portions of each phase of the incoming AC voltage. By only allowing portions of each phase to be conducted to the lamp, the amount of power delivered is thereby reduced. A problem with such dimming devices, when applied to gas discharge lamps, is that full power is needed to start the lamp because of the thermionic emission requirement discussed above. This means that a user must first apply full power to the lamp and then manually adjust the dimming device to the desired level. The dimming device cannot, therefore, be left at the desired setting since it must be readjusted every time the lamp is turned on. Also, when power outages occur, the lamps will not start automatically when power is returned if the dimming device is operative, again requiring manual intervention.

One such dimming device which attempts to deal with the problem of starting gas discharge lamps is that disclosed in U.S. Pat. No. 4,287,455. The '445 device uses power switch SCR's which are gated by a unijunction transistor via a control switch SCR and a pair of optocouplers. In order to effect the appropriate phase control, the power switch SCR's are non-conducting until the unijunction transistor fires a pulse. The unijunction transistor does not fire until a group of capacitors connected to the emitter are charged to the required value. The charging of the capacitors is done by the incoming AC voltage as seen on the secondary side of a transformer and rectifying bridge circuit which is then fed to the capacitors through a potentiometer. Thus, the phase portion of the incoming AC voltage which is conducted to the load depends upon the values of the capacitors and the setting of the potentiometer. In order to provide automatic starting when the device is set to dim the lamp, the capacitors also receive charging current through a charging diode which is also connected to the collector of a starting transistor. Another pair of capacitors are connected to the base of the starting transistor. When that pair of capacitors is charged, the transistor is turned on which reverse biases the charging diode no longer enabling the capacitors connected to the unijunction transistor to be charged via that pathway. Therefore, when power is initially applied to the device, the unijunction transistor capacitors are charged via both the charging diode pathway as well as the potentiometer pathway which causes triggering of the unijunction transistor earlier in the AC cycle than in normal dimming operation. Supposedly, enough power is transmitted to start the lamp before the starting transistor turns on. The capacitors connected to the base of the starting transistor are discharged whenever the power is turned off, thus enabling another starting operation when power is returned.

The device described above, however, suffers from several shortcomings. First, full power is never directly applied to the load during the starting operation. Instead, the power switch SCR's are simply triggered earlier than during normal dimming operation. This means that whether enough power is delivered to start the lamps will depend on the load since, if enough lamps are connected to the device, it is possible that only full power will start the lamps. Second, part of the charging current for the unijunction transistor capacitors always flows through the potentiometer. At a high dim setting, the triggering of the unijunction transistor occurs later in the AC cycle even during the starting operation. Again, depending on the load, the resulting amount of power transmitted may not be enough to start the lamps. Third, the capacitors connected to the starting transistor must discharge enough to turn off the starting transistor before the starting operation can take place. This supposedly happens whenever power is removed from the device, but a power outage of sufficiently short duration would not allow the capacitors to discharge while still extinguishing the lamp. In that case, the lamps would have to be restarted manually.

Therefore, it is an object of the present invention to provide a dimming apparatus, connectable to the ballast of an ordinary gas discharge lamp, which provides an adjustable degree of dimming while allowing the lamp to be started without disturbing the dimming adjustment. It is a further object to provide a dimming apparatus which applies full power to the lamp or lamps upon initial starting with no dependence upon the dimming adjustment.

DETAILED DESCRIPTION OF THE INVENTION

Figure 1:
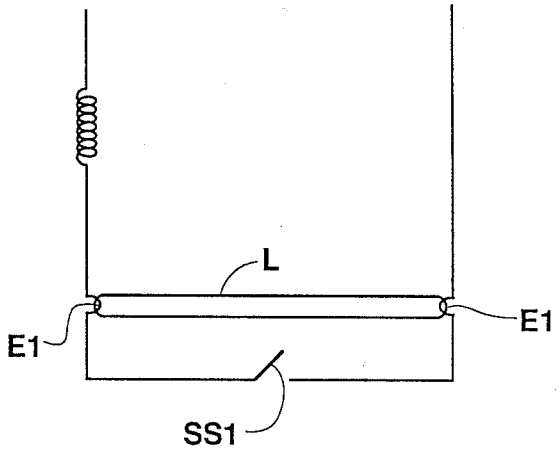
Fig. 1 (PRIOR ART)
FIG. 1 is a schematic depicting a simple starter circuit for a gas discharge lamp.
Figure 2:
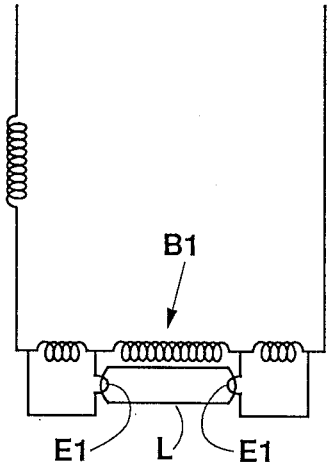
Fig. 2 (PRIOR ART)
FIG. 2 is a schematic depicting a starterless ballast circuit.
Figure 3:
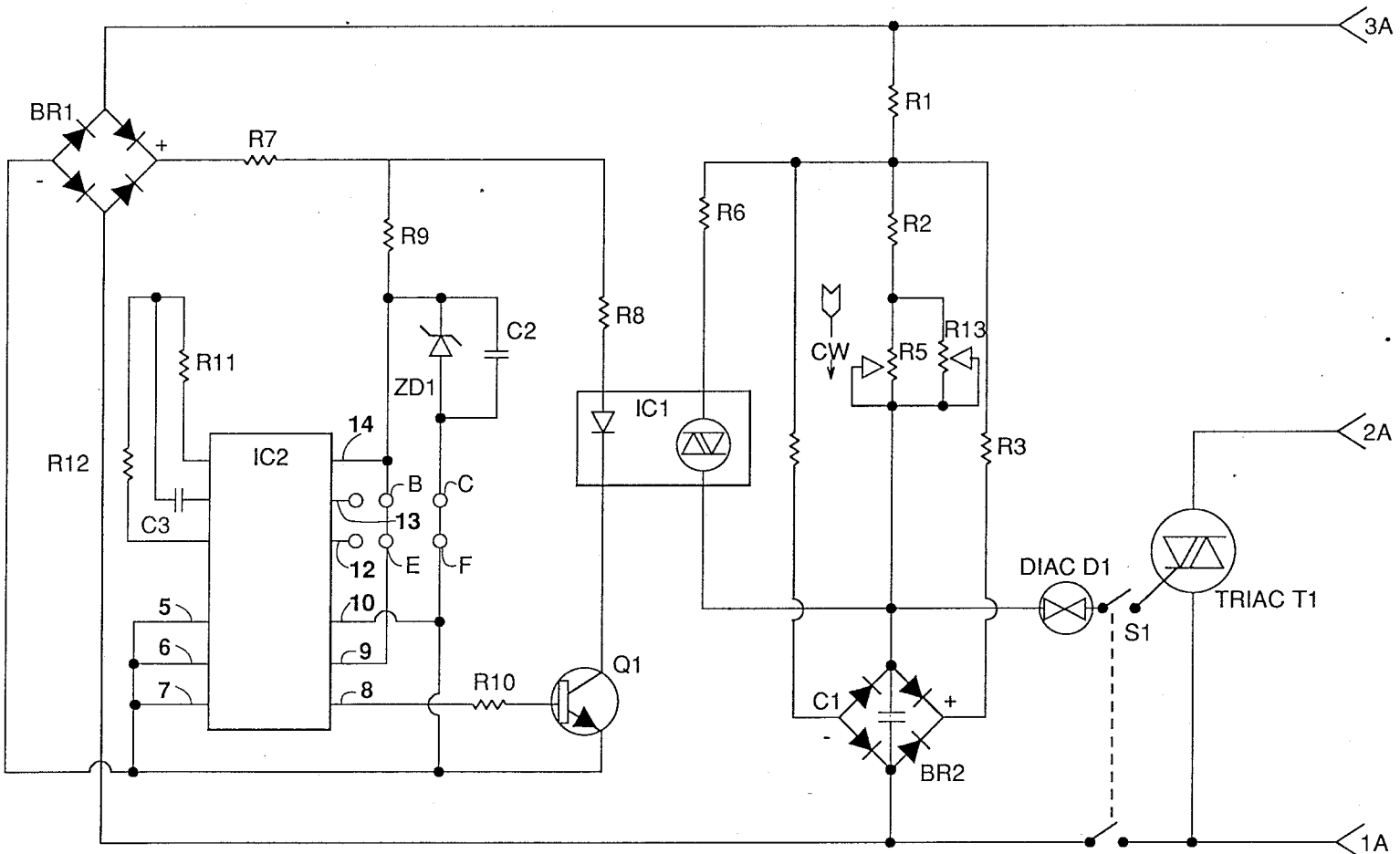
FIG. 3 is a circuit diagram of the preferred embodiment of the present invention.

FIG. 3 is a schematic of the preferred embodiment of the present invention. AC line voltage is applied across terminals 1A and 3A, with terminal 3A connected to the current carrying neutral line. A lamp fixture is connected across terminals 2A and 3A. The fixture is assumed to include some type of ballast as described above.

The incoming AC line voltage from terminals 1A and 3A is applied to two of the terminals of full-wave bridge rectifier BR1. The rectified output of rectifier BR1 provides power to timer chip IC2 and optoisolator chip IC1. The negative terminal of rectifier BR1 is connected to pins 5, 6, 7, and 10 of timer chip IC2 as well as the emitter of transistor Q1, forming essentially a floating ground.

Timer chip IC2, in this preferred embodiment, is a National Semiconductor CD4541B programmable timer. The chip contains an internal oscillator circuit designed for use with an external capacitor and two resistors, designated in FIG. 3 as C3, R12 and R11, respectively. This RC network determines the frequency of the internal oscillator which drives the internal counter of chip IC2. Power is applied to chip IC2 at pin 14 from the positive terminal of rectifier BR1 through resistors R7 and R9. Zener diode ZD1 and capacitor C2 are used to both filter and limit the output of rectifier BR1 which is applied to pin 14.

Pins 13 and 12 of chip IC2 can be selectively connected to either of terminals B and C, or E and F, respectively, to select any one of four counter stages internal to chip IC2 which divide the oscillator frequency by one of four division ratios, $2^8$, $2^{10}$, $2^{13}$, or $2^{16}$. When the selected counter times out, the output of chip IC2 at pin 8 changes state. The timed out output at pin 8 can be selected to be either high or low depending on the voltage applied to pin 9. In this case, the timed out value of the output of pin 8 is chosen to be low. Pin 10 controls whether or not chip IC2 operates in a single cycle or multicycle mode. For the present invention, the single cycle mode is chosen so that after the counter times out, the output at pin 8 goes low and remains low until power is removed and turned on again.

The output at pin 8 is connected through resistor R10 to the base of transistor A1. The collector of transistor A1 is connected to one side of a light emitting diode internal to optoisolator chip IC1. In this preferred embodiment, chip IC1 is an MOC3020 optically isolated triac driver chip manufactured by Motorola. The other side of the light emitting diode is connected through resistors R7 and R8 to the positive terminal of rectifier BR1. When current flows through the light emitting diode, a phototriac internal to chip IC1 is driven to deliver voltage to diac D1. This voltage exceeds the breakover voltage of diac D1, and current is conducted into the gate input of triac T1. Thus, when transistor A1 is turned on, full power is applied to the lamp 4A through triac T1.

When transistor A1 is turned off, however, triac T1 conducts only during portions of the AC cycle in accordance with what is essentially a conventional dimming circuit for gas discharge lamps. Bridge circuit BR2 contains a timing capacitor which, when charged to the breakover voltage of diac D1 during either the positive or the negative half of the AC cycle, discharges into the gate of triac T1 and causes the triac to conduct the incoming AC line voltage to the load for the remainder of that half cycle. The diodes of bridge circuit BR2 cause the timing capacitor to be reset to the same voltage level after each positive or negative half-cycle. The timing capacitor is charged through the network of resistors comprising resistors R1, R2, R3, and R4 as well as potentiometers R5 and R13. Potentiometers R5 and R13 are used to adjust the charging time of the timing capacitor and, therefore, the amount by which the light is dimmed.

Double pole switch S1 allows the apparatus to be disconnected from the supply voltage. When switch S1 is opened, no gate current is available for triac T1 which results in electrical isolation of the load from the supply voltage as well.

The apparatus disclosed thus allows the user to adjust the dimming level without having to adjust it again when restarting the lamp. Full power is applied to the lamp by the apparatus for a preselected time upon initial application of power. After the preselected time, the apparatus acts as a conventional dimming device and conducts only a portion of the incoming AC voltage waveform to the lamp.

Although the invention has been described in conjunction with the foregoing specific embodiment, many alternatives, variations and modifications are apparent to those of ordinary skill in the art. Those alternatives, variations and modifications are intended to fall within the spirit and scope of the appended claims.

What is claimed is:

1. A power-saving dimming apparatus for a gas discharge lamp comprising:

means for conducting a portion of the voltage waveform of an AC supply voltage to the lamp wherein the waveform portion conducting means comprises a triac connecting the lamp to the AC supply voltage, a diac connected to the gate of the triac, and a timing capacitor connected to the diac and to the AC supply voltage through a resistor network;

means for adjusting the portion of the waveform so conducted to the lamp; and means for conducting the entire waveform of the AC supply voltage to the lamp for a preselected time upon initial application of power to the apparatus and conducting an adjustable portion of the waveform thereafter.

2. The apparatus of claim 1 wherein the means for adjusting the portion of the waveform conducted to the lamp comprises a potentiometer in the resistor network.

3. The apparatus of claim 1 wherein the means for conducting the entire waveform of the AC supply voltage to the lamp for a preselected time comprises:

a phototriac connected to the gate of the triac;

a light emitting diode coupled to the phototriac;

means for driving the light emitting diode upon initial application of power to the apparatus; and means for blocking current flow through the light emitting diode after a preselected time period measured from the initial application of power to the apparatus.

4. The apparatus of claim 1 further comprising means for adjusting the preselected time for which the entire waveform of the AC supply voltage is conducted to the lamp.

5. A power-saving dimming apparatus for a gas discharge lamp comprising:

means for controlling the phase of an AC supply voltage transmitted to a lamp wherein the phase control means comprises a triac connecting the lamp to the AC supply voltage, a diac connected to the gate of the triac, and a timing capacitor connected to the AC supply voltage which discharges into the gate of the triac through the diac when the breakover voltage of the diac is reached;

means for measuring the time from which the AC supply voltage is initially applied to the apparatus; and means for applying the entire phase of the AC supply voltage to the lamp for a preselected time and a controllable phase of the AC supply voltage to the lamp thereafter.

6. The apparatus of claim 5 wherein the means for applying the entire phase of the supply voltage to the lamp comprises a voltage source also connected the diac and triggered by the time measuring means.

7. The apparatus of claim 6 wherein the voltage source is a phototriac coupled to a light emitting diode and further wherein the current to the light emitting diode is controlled by the time measuring means.

* * * * *